US005154681A

United States Patent [19]

Denny

[11] Patent Number: 5,154,681

[45] Date of Patent: Oct. 13, 1992

[54] FOLDING DUMBELL AND BARBELL DEVICE

[76] Inventor: John E. Denny, P.O. Box 751, Cypress, Tex. 77429

[21] Appl. No.: 716,892

[22] Filed: Jun. 18, 1991

[51] Int. Cl.[5] ..... A63B 21/072

[52] U.S. Cl. ..... 482/108

[58] Field of Search ..... 272/117, 118, 119, 122, 272/123, 124, 143; 482/93, 105, 106, 108, 109, 139

[56] References Cited

U.S. PATENT DOCUMENTS

| | | | |
|---|---|---|---|
| D. 274,283 | 6/1984 | Wright | D21/197 |
| 786,318 | 4/1905 | Shepherd | 272/122 X |
| 3,588,102 | 6/1971 | Gifford | 272/123 |
| 3,726,522 | 4/1973 | Silberman | 272/84 |
| 3,781,007 | 12/1973 | Baker et al. | 272/84 |
| 3,825,253 | 7/1974 | Speter | 482/106 |
| 4,103,887 | 8/1978 | Shoofler | 272/123 |
| 4,199,140 | 4/1980 | Ferretti | 272/123 |
| 4,312,506 | 1/1982 | Brennan | 272/123 |
| 4,529,197 | 7/1985 | Gogarty | 272/122 |
| 4,531,728 | 7/1985 | Wright | 272/122 |
| 4,566,690 | 1/1986 | Schook | 272/123 |
| 4,579,337 | 4/1986 | Uyeda | 272/123 |
| 4,585,367 | 4/1986 | Gall | 403/104 |
| 4,695,051 | 9/1987 | Jenison | 227/122 |
| 4,817,944 | 4/1989 | Anderson et al. | 272/123 |
| 4,905,992 | 3/1990 | McWain | 272/123 |

*Primary Examiner*—Robert Bahr

*Attorney, Agent, or Firm*—Pravel, Gambrell, Hewitt, Kimball & Krieger

[57] ABSTRACT

A folding dumbell and barbell device having an elongated bar with weights mounted on opposing ends of the elongated bar. Each of the weights contain a pivoting mechanism within the body of the weights and a slot in the inner side of the weights which will receive the elongated bar when the weights are pivoted or folded to the folding position. The pivoting mechanism attaches to the end of the elongated bar in the slot, thereby providing a pivoting point inside the weights. Each of the weights also includes a locking mechanism which locks the weights in the open position while exercising. To fold the dumbell or barbell, the locking mechanism is disengaged, the weights pivot with the pivot mechanism and are folded over on the bar and receive the bar in the slot in the side of the weights. With the slot in the weights receiving the entire size of the bar, the folding dumbell and barbell device, when folded is the thickness of the weights. All parts remain attached for folding. There is no assembling or disassembling of parts in folding or unfolding the folding dumbell and barbell device.

19 Claims, 5 Drawing Sheets

FOLDING DUMBELL AND BARBELL DEVICE

BACKGROUND OF THE INVENTION

1. Field of the Invention

The present invention relates generally to exercise equipment, and more specifically to a folding dumbell and barbell device which allows the weights on the bar to remain in attachment to the bar and fold over the bar in a flat position where the weights receive the bar in a slot in the side of the weights.

2. Description of the Related Art

Generally speaking, the dumbell and barbell equipment used includes an elongated cylindrical bar, normally metallic, with circular plate or disk type weights positioned at opposite ends of the bar. A number of exercising movements can be performed with this equipment, normally toning muscles.

Exercising with weight equipment has become a common practice among many people. While gymnasiums and exercise or health clubs offer many types of exercise equipment to use, weight lifting devices such as dumbells and barbells are still widely used and popular types of exercise equipment. This is especially true within the home where space is more limited. Convenient and easy storage can be very important. In addition, with traveling, it would be convenient to have a dumbell and barbell device which would fold for easier storage and transporting.

With the dumbell and barbell equipment existing today, the most common ways for preparing this equipment for storage or transporting is to remove the weights, weight mechanisms, or parts of the weights from the bar. This creates the problem of having separate pieces to store or transport and having to reassemble the weights or parts back on the bar to use the dumbell or barbell for exercising. Where the weights are removed from the bar, both the bar and the weights must be handled. Where the weights involve filling a weight chamber with some type weight material, for example, water or sand, the bar, the weight chamber, and maybe even the weight material needs to be handled.

Various types of dumbell and barbell equipment, other than the common bar and plate combination, have been described before in previous patents as offering features that would assist in storage and transporting through the following ways: easily removable weights, collapsible weight systems, hollow weights or weight chambers, folding bars, mechanisms for retaining weights on the bar, special locking devices, releasing locking devices, etc. For examples, see U.S. Pat. Nos. D274,283, 3,726,522, 3,781,007, 4,103,887, 4,199,140, 4,312,506, 4,531,728, 4,529,197, 4,566,690, 4,579,337, 4,585,367, 4,695,051, 4,817,944, 4,905,992. However, none of these references provide for dumbell or barbell equipment which allows the weights on the bar to fold over the bar, receiving the bar in a slot in the side of the weight, while the weight remains in attachment to the bar.

SUMMARY OF THE INVENTION

The present invention is a folding dumbell and barbell device with an elongated bar with weights secured adjacent the opposed ends of the elongated bar. The weights are connected to the bar by way of a pivoting mechanism inside the weight itself, thereby allowing the weight to pivot or fold at a point inside the weight while the weight remains in attachment to the bar. The weights pivot and fold over the bar, and receive the bar in a slot in the side of the weights, thereby providing a flattened, folded dumbell and barbell device for storage or transporting with the weights attached to the bar by the pivoting mechanism. The weights include a slot in the inside side of each weight which receives the bar when the weight is folded over on the bar. If the slot is of sufficient size, width and depth, to receive the entire bar diameter, the folding dumbell and barbell device can be folded to a folded dumbell or barbell of the same thickness as the thickness of the weights. The folding dumbell and barbell device in accordance with the present invention provides many advantages in the area of folding for storage and transportation and the area of unfolding for use.

The weights stay in attachment to the pivoting mechanism and the pivoting mechanism stays in attachment to the bar in the same manner, whether the folding dumbell and barbell device in accordance with the present invention is in the open and usable position or whether it is in the folding or closed position for storage and transporting. Therefore, when the folding dumbell and barbell device is to be folded for storage, or other reasons, there are no disconnects or change in connections. The folding dumbell and barbell device is easy to fold. To fold from the open position, a locking mechanism is released and the weights can be folded over. The weights fold down over the bar, and the weights receive the bar in a slot on the inside side of the weights. The pivoting of the weight on the end of the bar, when folding, occurs inside of the weight itself. Therefore, when the weight is folded over against the bar, receiving the bar in the slot, this can provide a flattened unit from the folding dumbell and barbell device the same thickness as the weights, where the weights remain in connection to the bar in the same manner as when the folding weight training device is in the open or usable position. The device is easy to unfold. When the folding dumbell and barbell device is to be used, the weights fold out to the open position and is ready for use.

There are no connections or disconnections to be made to fold the folding dumbell and barbell device for storage, for transporting, or to open it to be used from the folded position. To fold, a locking mechanism is unlocked and the weight folds over. To open, the weight is just unfolded to the open position, and the locking mechanism locks it open.

The folding dumbell and barbell device is self-contained, in that no weight material, other than the device as described hereinabove, is needed, for example, water, sand, etc. The folding dumbell and barbell device has all the needed parts to use the device connected together.

When the folding dumbell and barbell device is in the open position, it provides a well-balanced barbell or dumbell for use that retains excellent balance and a comfortable size, feel, and appearance. It is understood that the bar can be provided in a variety of configurations. For example, the bar can be cylindrical or modified cylindrical where two sides are flattened somewhat giving an oval shape. Also, the bar can be knurled, smooth, or some combination. It is also understood that the bar can be in different lengths to provide a dumbell or barbell in accordance with the present invention.

The folding dumbell and barbell device in accordance with the present invention can be easily used for exercise, and when not in use, the weights can be folded over on the bar, converting the device to a folded dumbell and barbell unit which can be the same thickness as the weights.

The weights remain in connection to the bar by way of the pivoting mechanism when the folding dumbell and barbell device is folded in the same manner as when in use, except, the weights rotate on the pivoting mechanism 90 degrees to fold. The pivoting mechanism is embodied inside the weights, thereby, providing the pivot point inside the weights. Therefore, when the weights fold over on the bar, and the weights receive the bar in to a slot on the side of the weights, the bar is actually received within the body of the weights when folded. The folding and unfolding requires no disconnects or connects, thereby making the folding and unfolding easy and convenient. There are no extra parts. The folding dumbell and barbell device is one self-contained unit, in use or when folded for storage or transporting.

BRIEF DESCRIPTION OF THE DRAWINGS

In order that the features of this invention may be better understood, a detailed description of the invention, as illustrated in the attached drawings, follows.

DETAILED DESCRIPTION OF THE INVENTION

Figure 1:
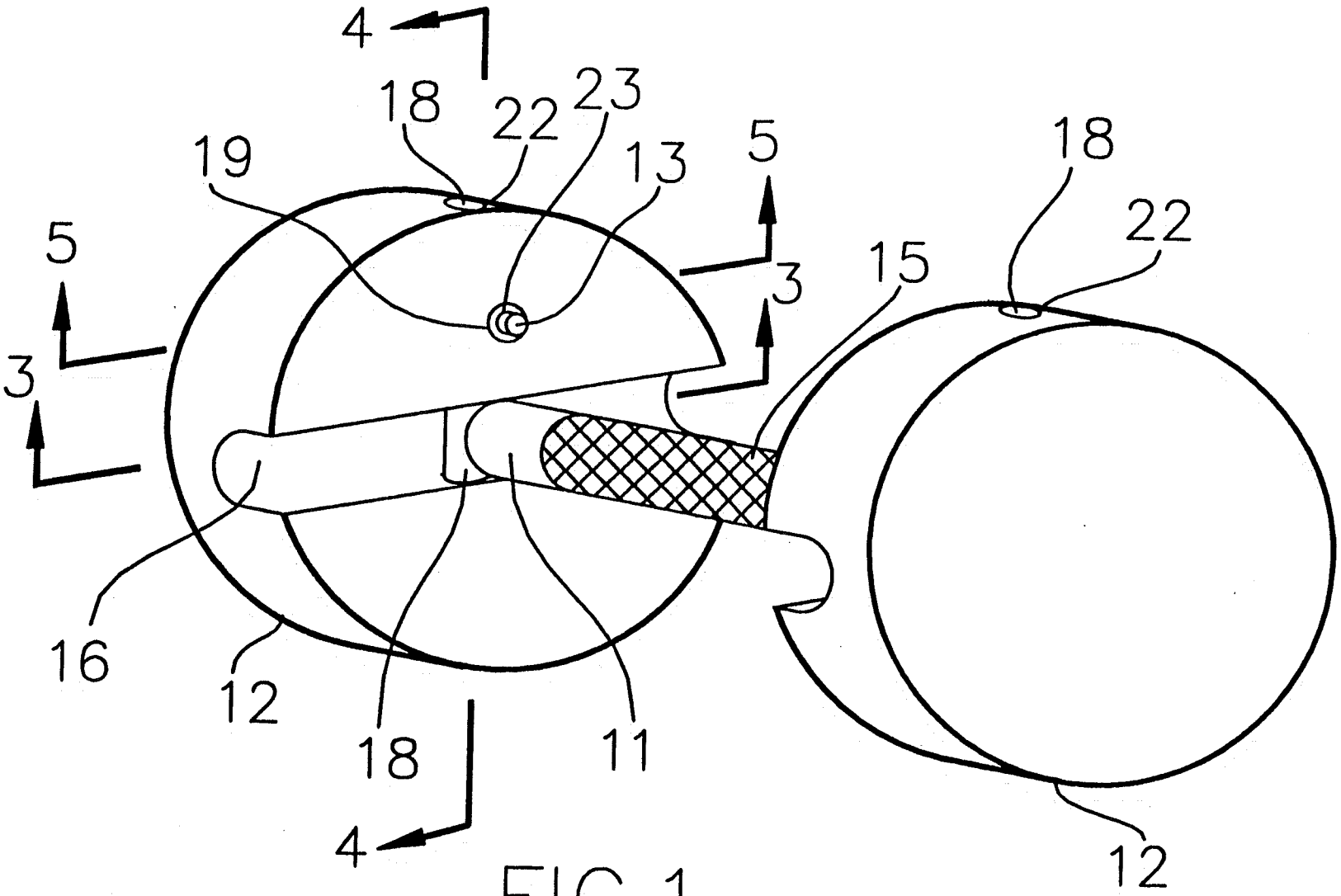
FIG. 1 is a perspective view of a folding dumbell device made in accordance with the present invention in the open or usable position.
Figure 2:
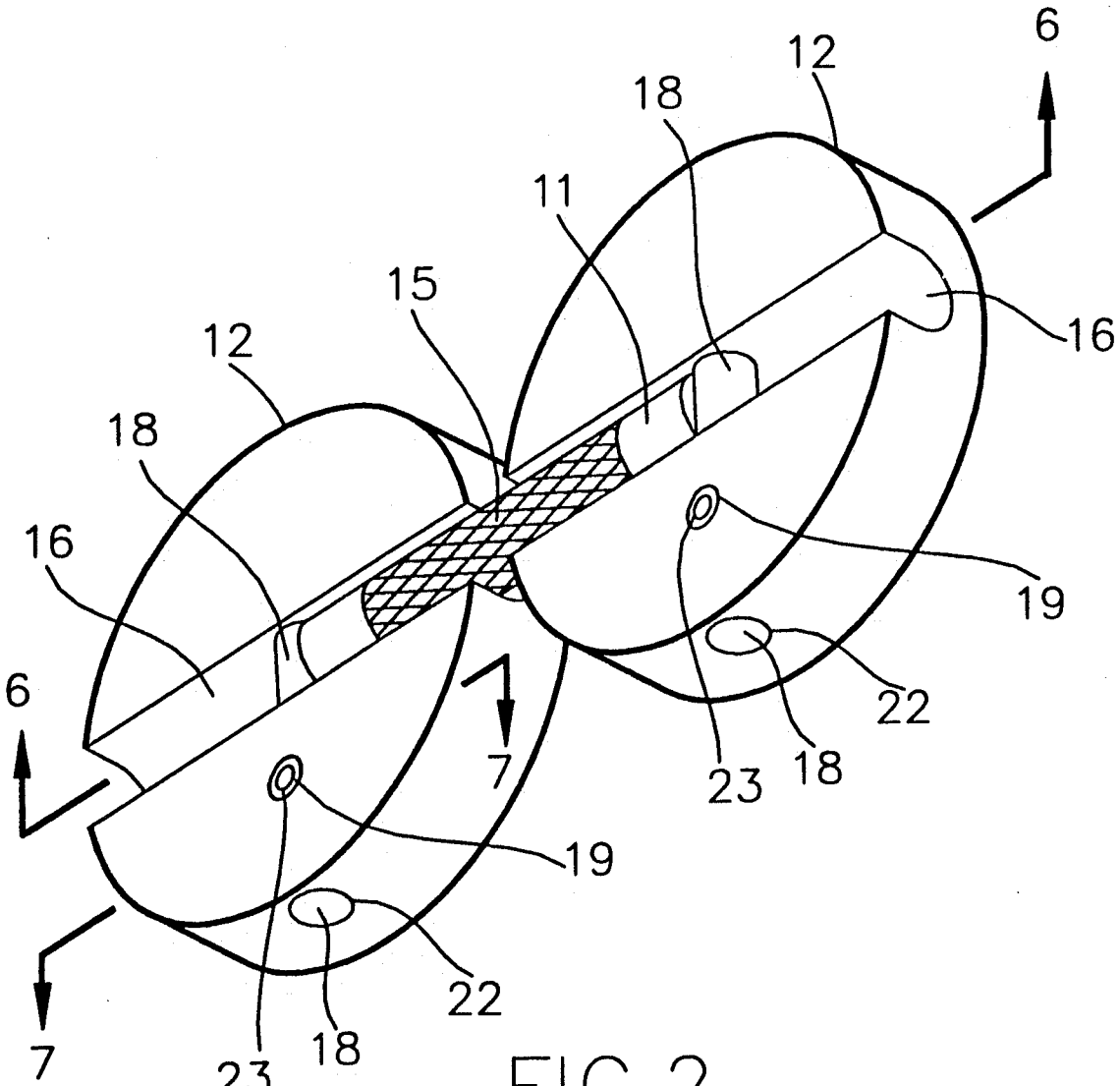
FIG. 2 is a perspective view of a folding dumbell device made in accordance with the present invention in the folded position;.
Figure 4:
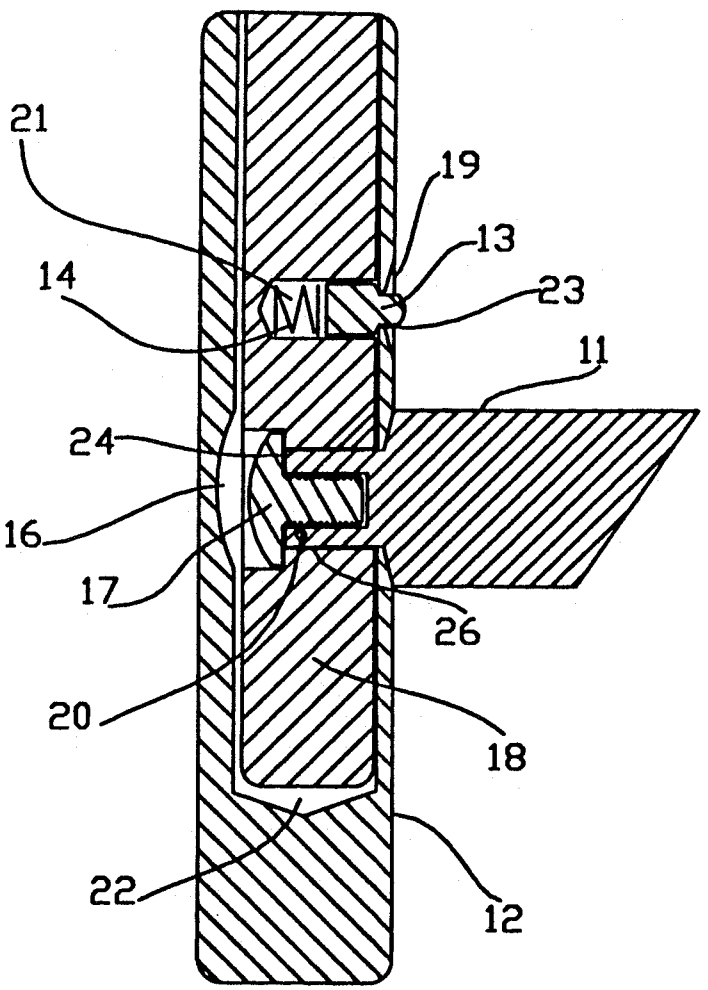
FIG. 4 is a cross-sectional view along line 4—4 of FIG. 1 illustrating the locking mechanism with the weight in the open or usable position in relation to the attachment of the weight to the bar.
Figure 6:
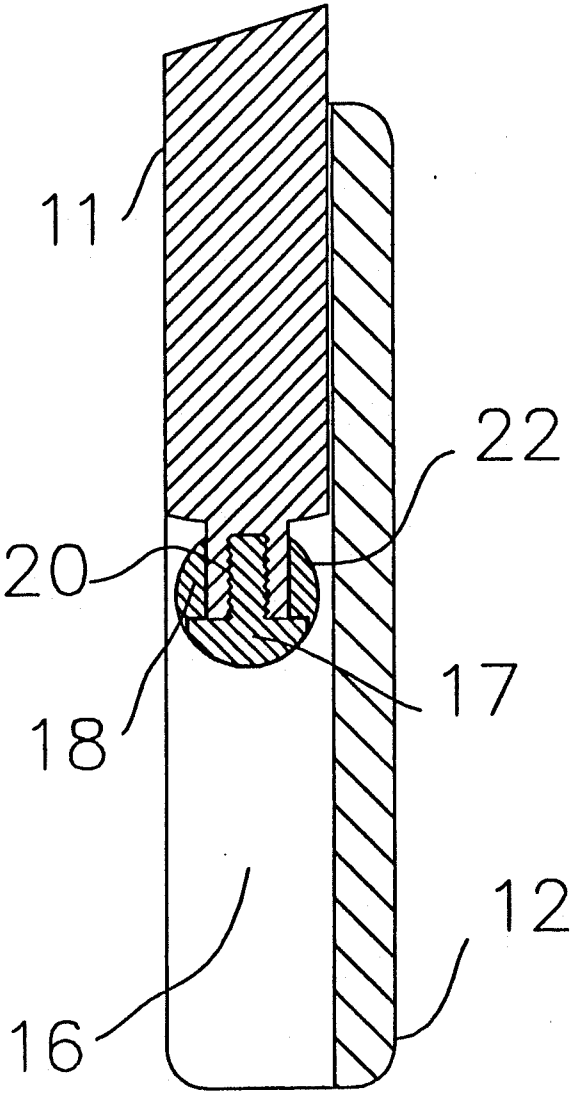
FIG. 6 is a partial cross-sectional view along line 6—6 of FIG. 2 illustrating the weight and the bar when the folding dumbell device is folded.
Figure 5:
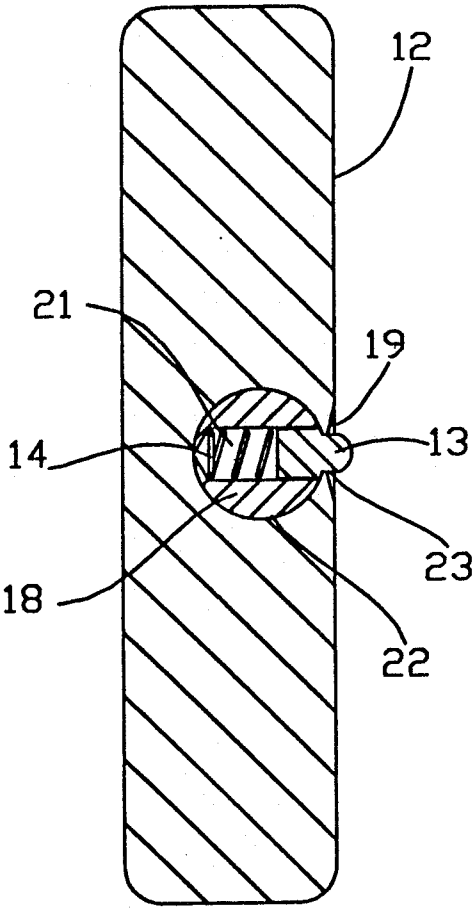
FIG. 5 is a cross-sectional view along line 5—5 of FIG. 1 illustrating the position of the locking mechanism when the folding dumbell device is locked in the open or usable position.
Figure 7:
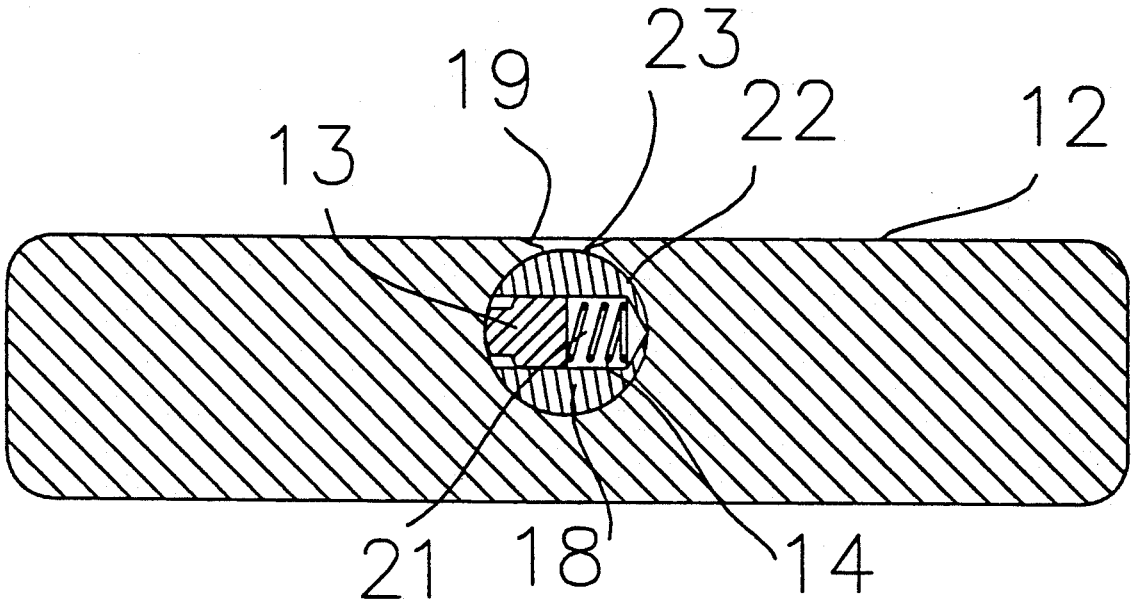
FIG. 7 is a cross-sectional view along line 7—7 of FIG. 2 illustrating the locking mechanism when the folding dumbell device is folded.

A folding dumbell and barbell device in accordance with the present invention is depicted in FIGS. 1-7. For illustration, a folding dumbell device will be shown in FIGS. 1-7, although, it is understood that the illustrations would also apply to a folding barbell device. Referring to FIGS. 1 and 2, the folding dumbell device includes a central elongated bar 11, to be used as a handle, with a weight 12 attached to each end of the bar 11. FIGS. 1-7 illustrate a weight 12 attached to a bar 11 by way of a pivot pin 18. The pivot pin 18 inserts in to the pivot pin shaft 22 which is inside the body of the weight 12, as shown in FIG. 4. The bar 11 attaches to the pivot pin 18, with a screw 17, shown in more detail in FIGS. 3, 4, and 6. As shown in FIGS. 4, 5, and 7, the pivot pin 18 allows the weight to pivot or rotate and fold over, when the keeper lock 13 is depressed, with the bar 11 resting in a bar nest slot 16 in the side of the weights 12.

In general, the folding dumbell and barbell device in accordance with the present invention may be made of any suitable material which provides the desired characteristics, for example, strength, texture, weight, etc. However, the material will normally be metal or a combination thereof.

It is understood that there will be a weight 12 on each end of the bar 11 in accordance with the present invention, and each weight 12 will be of identical configuration, design, and operation. On the same folding dumbell device, each of the weights 12 will be the same size and will weigh the same. However, on a different folding dumbell device, the weights 12 may be a different size and weight to provide a folding dumbell device of different weight for exercising. The dumbell bar 11 could be cylindrically shaped or it could be modified, for example, flattened some to give an oval shaped bar 11. The bar 11 could include knurls 15 over the entire surface of the bar 11, or knurls 15 could be placed at locations on the bar 11 where the bar 11 would normally be gripped by the hand in exercising.

In FIG. 1, the weight 12 is attached to the bar 11 by way of a pivot pin 18 which can pivot in the pivot pin shaft 22 located inside the body of the weight 12. The pivot pin 18 is inserted in to the pivot pin shaft 22 from the edge of the weight 12. The bar 11 attaches to the pivot pin 18 in the center of the inner side of weight 12, where the bar nest slot !6 exposes the pivot pin 18. The bar 11 has a bar offset 20, shown in FIGS. 3, 4, and 6, which inserts in to the pivot pin 18 and is attached by a screw 17, shown in FIGS. 3, 4, and 6.

FIG. 1 also shows the bar nest slot 16 and a lock indent 19 with the keeper lock 13. The keeper lock 13 is in the locked position and extends out through a lock indent opening 23, when the weight is open or in the usable position, as in FIG. 1. The bar nest slot 16, as shown in FIG. 1, extends across the diameter of the inner side of the weight 12 allowing the weight 12 to fold down to either side of the bar and for providing better balance to the weight 12. The bar nest slot 16 could extend only across approximately one-half the diameter of the weight 12, that is, one-half the diameter of the weight 12 plus one-half the diameter of the bar 11, allowing the bar 11 room to attach properly to the pivot pin 18.

Although FIGS. 1-7 show only one locking mechanism, it is understood that there could be more than one locking mechanism to keep the folding dumbell device in the open position, if needed to sufficiently stabilize the weight 12. As shown in FIGS. 4, 5, and 7, a locking mechanism, in accordance with the present invention, includes a keeper lock 13, keeper spring 14, lock indent 19, keeper nest 21, and a lock indent opening 23. It is also understood, in accordance with the present invention, that a locking mechanism could be added to keep or lock the weight 12 in the closed or folded position as folded in FIG. 2, although, it is not shown.

Attention is next directed to FIG. 2 which shows the folding dumbell device in accordance with the present invention in the folded or closed position. The bar 11 is resting in the bar nest slot 16, such that, when the bar nest slot 16 is of sufficient width and depth to receive the entire bar size, the folding dumbell device can be the same thickness as the weight 12 on each end of the bar 11.

When the folding dumbell device is being folded or is folded, the bar 11 remains attached to the pivot pin 18, and the pivot pin 18 remains inserted in the pivot pin shaft 22, inside the weight 12. Thus, the bar remains in attachment to the weight 12 when the device is being folded or is in the folded position. The weight 12 is not disassembled from the bar 11 and pivoting pin 18 to fold. It folds by pivoting on the pivot pin 18 after the keeper lock 13 is depressed.

Figure 3:
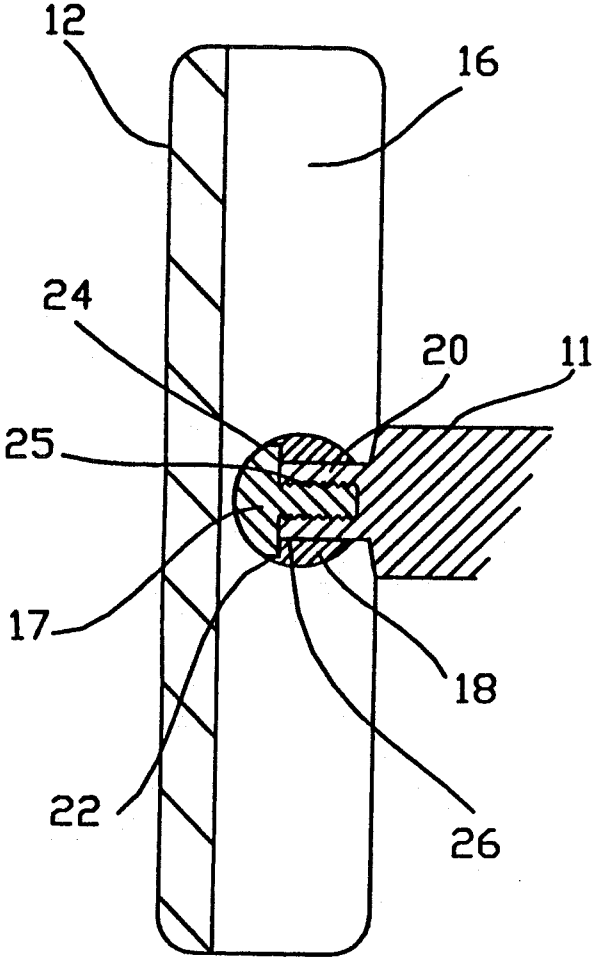
FIG. 3 is a cross-sectional view along line 3—3 of FIG. 1 illustrating the attachment of the weight to the bar, by way of a pivot pin, and the slot in the weight when the folding dumbell and barbell is in the open or usable position.

FIG. 3 shows the bar offset 20 inserted in a hole 26 in the pivot pin 18 and attached to the pivot pin 18 with a screw 17. The screw 17 screws into an opening 25 in the bar offset 20 and pulls down until the head of the screw 17 rests against a pivot pin screw rest 24. FIG. 3 also shows the bar nest slot 16 in the weight 12 from a center cross sectional view. The pivot pin 18 inserts in the pivot shaft 22 and the weight 12 will pivot on the pivot pin 18 in the open position, as shown in FIG. 4, and also in the folded position as shown in FIG. 6.

FIG. 4 shows the relative location of the locking configuration to the bar 11 and the bar nest slot 16 when the folding dumbell device is in the open position. It is understood that the locking mechanism could be at different positions along the pivot pin 18. As depicted in FIG. 4, when the folding dumbell device is in the open position, the keeper lock 13 is extended and extends through the lock indent opening 23 which locks the folding dumbell device in the open position. The keeper lock 13 is extended through the lock indent opening 23 by the pressure exerted on the keeper lock 13 from the keeper lock spring 14 located behind it in the keeper nest 21. When the weight is in the open position, the bar 11 enters the weight 12 in the center of the inner side of the weight 12. It is understood that the keeper nest 21, keeper lock 13, keeper spring 14, lock indent 19, and lock indent opening 23 may vary in size, shape, and form depending on the need, for example, the size and weight of the weights 12. The pivot pin 18 and the pivot shaft 22 can also vary in size, length, or shape depending on need.

In FIG. 5, the keeper lock 13 is shown with the weight 12 in the open or usable position. The keeper lock 13 is extending out of the lock indent opening 23 far enough for it to lock the pivot pin 18 in that position, thereby holding the weight 12 in the open or usable position. In this position, the keeper spring 14 is the least compressed.

FIG. 6 shows the bar 11 resting in the bar nest slot 16, with the folding dumbell device in the folded position. The edge of the bar !1 can be level or below the edge of the inner side of the weight 12, when folded, so the bar 11 is received in the bar nest slot 16. The bar 11 remains attached to the pivot pin 18 and therefore remains in attachment to the weight 12. The folding dumbell device, in the folded position as shown in FIG. 6, can be the same thickness as the weights 12.

FIG. 7 depicts the keeper lock 13 when weight 12 is in the folded position. When weight 12 is in the folded position, it has rotated or pivoted approximately 90 degrees from the open position. The keeper lock 13 is shown in the depressed position and rotated approximately 90 degrees from the lock indent opening 23. The keeper lock 13 is depressed farther in to the keeper nest 21 and is held depressed by the inside of the pivot pin shaft 22. When the weight 12 is folded, the keeper spring 14 is in the compressed position. It is understood that there may be more than one keeper lock mechanism if needed, for example, to handle larger or heavier dumbell or barbell equipment.

Although a specific folding dumbell and barbell device has been described hereinabove in accordance with the present invention, for the purpose of illustrating how the invention may be used to advantage, it should be understood that the invention is not limited thereto. Therefore, in accordance, any modifications, variations, or equivalent designs or structures may be made without departing from the spirit of the invention.

I claim:

1. A folding dumbell device comprising:

an elongated bar having a first end and a second end, said elongated bar having a cross sectional area;

a pair of weighted members, each said weighted member having a generally planar surface with a planar surface area, each said weighted member further having a recessed portion in said planar surface; and means for pivotably connecting said weighted members to said first and second ends of said elongated bar and said means for pivotably connecting including a pivot point;

wherein said weighted member planar surface area is substantially greater than said elongated bar cross sectional area and said pivot point is contained in said recessed portion of said weighted members and said weighted members pivot from a substantially perpendicular position with respect to said elongated bar to a substantially parallel position with respect to said elongated bar.

2. The folding dumbell device of claim 1, wherein said pivotably connecting means is totally contained in said recessed portion of said weighed members.

3. The folding dumbell device of claim 1, wherein said weighted members are substantially flat and have a thickness and said elongated bar has a diameter which is slightly less than said weighted member thickness.

4. A folding dumbell device comprising:

an elongated bar having a first end and a second end;

a first weighted member having a generally planar surface, said generally planar surface facing said elongated bar and said first weighted member having a first receiving means in said generally planar surface for at least partially receiving said elongated bar;

a second weighted member having a generally planar surface, said generally planar surface facing said elongated bar and said second weighted member having a second receiving means in said generally planar surface for at least partially receiving said elongated bar;

first means for pivotably connecting said first end of said elongated bar to said first weighted member; and second means for pivotably connecting said second end of said elongated bar to said second weighted member;

wherein said first and second weighted members pivot such that said generally planar surfaces pivot from a substantially perpendicular position with respect to said elongated bar to a substantially parallel and flatly folded position with respect to said elongated bar, said first and second receiving means at least partially receiving said elongated bar when in the substantially parallel and flatly folded position.

5. The folding dumbell device of claim 1, wherein said first and second means for pivotably connecting allow each said weighted member to pivot approximately ninety degrees with respect to said elongated bar.

6. The folding dumbell device of claim 1, wherein said first and second means for pivotably connecting allow each said weighted member to pivot approximately one hundred eighty degrees with respect to said elongated bar.

7. The folding dumbell device of claim 1, wherein said first means for pivotably connecting comprises:

a first pivot pin rotatably attached to said first weighted member; and first means for fastening said first end of said elongated bar to said first pivot pin; and wherein said second means for pivotably connecting comprises:

a second pivot pin rotatably attached to said second weighted member; and second means for fastening said second end of said elongated bar to said second pivot pin.

8. The folding dumbell device of claim 1, further comprising:

first means for locking said first weighted member in said perpendicular position, said first means for locking being disengaged to allow said first weighted member to pivot to said substantially parallel and folded position; and second means for locking said second weighted member in said perpendicular position, said second means for locking being disengaged to allow said second weighted member to pivot to said substantially parallel and folded position.

9. A folding dumbell device comprising:

an elongated bar having a first end and a second end;

a first weighted member having a generally planar surface;

a second weighted member having a generally planar surface;

first means for pivotably connecting said first end of said elongated bar to said first weighted member, said first pivotably connecting means comprising:

a first pivot pin rotatably attached to said first weighted member; and first means for fastening said first end of said elongated bar to said first pivot pin;

second means for pivotably connecting said second end of said elongated bar to said second weighted member, said second pivotably connecting means comprising:

a second pivot pin rotatably attached to said second weighted member; and second means for fastening said second end of said elongated bar to said second pivot pin, wherein said first and second weighted members pivot such that said generally planar surfaces pivot from a substantially perpendicular position with respect to said elongated bar to a substantially parallel and flatly folded position with respect to said elongated bar, and wherein each said weighted member generally planar surface faces said elongated bar, each said weighted member includes an elongated slot in said generally planar surface for receiving said elongated bar when said weighted member is positioned substantially parallel to said elongated bar in a folded position.

10. The folding dumbell device of claim 9, wherein said first weighted member includes a first pivot pin shaft which intersects the elongated slot, the first pivot pin shaft receiving said first pivot pin and allowing said first weighted member to rotate about said first pivot pin;

wherein said second weighted member includes a second pivot pin shaft which intersects the elongated slot, the second pivot pin shaft receiving said second pivot pin and allowing said second weighted member to rotate about said second pivot pin; and wherein said elongated bar connects to said first and second pivot pins in the elongated slot in said first and second weighted members.

11. A folding dumbell device comprising:

an elongated bar having a first end and a second end;

a first weighted member having a generally planar surface;

a first pivot pin attached to said first weighted member allowing said first weighted member to rotate about said first pivot pin;

first means for fastening said first end of said elongated bar to said first pivot pin;

a second weighted member substantially identical to said first weighted member;

a second pivot pin attached to said second weighted member allowing said ssecond weighted member to rotate about said second pivot pin; and second means for fastening said second end of said elongated bar to said second pivot pin, wherein each said weighted member generally planar surface faces said elongated bar, each said weighted member includes an elongated slot in said generally planar surface for receiving said elongated bar when said weighted member is positioned substantially parallel to said elongated bar in a folded position.

12. The folding dumbell device of claim 11, wherein said first weighted member includes a first pivot pin shaft which intersects the elongated slot, the first pivot pin shaft receiving said first pivot pin and allowing said first weighted member to rotate about said first pivot pin;

wherein said second weighted member includes a second pivot pin shaft which intersects the elongated slot, the second pivot pin shaft receiving said second pivot pin and allowing said second weighted member to rotate about said second pivot pin; and wherein said elongated bar connects to said first and second pivot pins in the elongated slot in said first and second weighted members.

13. The folding dumbell device of claim 12, further comprising:

first means for locking said first weighted member in a position substantially perpendicular to said elongated bar, said first means for locking being disengaged to allow said first weighted member to pivot to said substantially parallel and folded position; and second means for locking said second weighted member in a position substantially perpendicular to said elongated bar, said second means for locking being disengaged to allow said second weighted member to pivot to said substantially parallel and folded position.

14. A folding dumbell device comprising:

an elongated bar having a first end and a second end;

a pair of weighted members, each said weighted member having a generally planar surface which faces said elongated bar, each said weighted member including an elongated slot across said generally planar surface for receiving said elongated bar when said weighted member is positioned substantially parallel to said elongated bar in a folded position; and means for pivotably connecting said weighted members to said first and second ends of said elongated bar;

wherein said means for pivotably connecting allows each said weighted member to pivot approximately ninety degrees with respect to said elongated bar while remaining in attachment to said elongated bar.

15. The folding dumbell device of claim 14, wherein said means for pivotably connecting is contained within each said weighted member.

16. The folding dumbell device of claim 15, wherein said means for pivotably connecting comprises:

a pivot pin for each said weighted member rotatably attached to said weighted member; and means for fastening said first and second ends of said elongated bar to said pivot pins.

17. The folding dumbell device of claim 16, wherein each said weighted member includes a pivot pin shaft which intersects the elongated slot, the pivot pin shaft receives said pivot pin and allows said pivot pin to rotate in the pivot pin shaft of each said weighted member.

18. The folding dumbell device of claim 17, wherein said elongated bar is connected to each said pivot pin in the elongated slot of each said weighted member.

19. The folding dumbell device of claim 18, further comprising:

means for locking each said weighted member generally planar surface in a substantially perpendicular position with respect to said elongated bar, said means for locking being disengaged to allow said weighted member to pivot to said substantially parallel and folded position.

* * * * *